US012522986B2

(12) United States Patent
Engelmann et al.

(10) Patent No.: US 12,522,986 B2
(45) Date of Patent: Jan. 13, 2026

(54) MILLING MACHINES, SYSTEMS, AND RELATED METHODS

(71) Applicant: Caterpillar Paving Products Inc., Brooklyn Park, MN (US)

(72) Inventors: Eric S. Engelmann, Delano, MN (US); Dario Sansone, Castello d'Argile (IT); Nathan L. Mashek, Saint Michael, MN (US); Timothy J. Sturos, Brooklyn Park, MN (US); Jameson M. Smieja, Mound, MN (US); Anthony Keng Yew Low, Singapore (SG); Nicholas B. Johnson, Dayton, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 976 days.

(21) Appl. No.: 17/515,189

(22) Filed: Oct. 29, 2021

(65) Prior Publication Data

US 2023/0135083 A1 May 4, 2023

(51) Int. Cl.
*E01C 23/12* (2006.01)
*E01C 23/088* (2006.01)

(52) U.S. Cl.
CPC ..... *E01C 23/088* (2013.01); *E01C 2301/40* (2013.01); *E01C 2301/50* (2013.01)

(58) Field of Classification Search
CPC ..... E01C 2301/50
See application file for complete search history.

(56) References Cited

U.S. PATENT DOCUMENTS 2,424,460 A * 7/1947 Hettelsater ..... E02D 3/126 37/189
3,287,903 A * 11/1966 Wixkman ..... F02C 7/36 60/39.163
3,767,262 A * 10/1973 Pentith ..... E01C 23/088 37/189
4,523,361 A 6/1985 Dummermuth
4,714,374 A * 12/1987 Mihara ..... B28D 1/188 404/91
4,780,022 A 10/1988 Ohiba et al.
5,203,615 A * 4/1993 Zanetis ..... E01C 23/088 404/90
5,382,084 A * 1/1995 Diver ..... E01C 23/088 299/39.5
5,626,197 A * 5/1997 Tseng ..... E01C 23/082 172/554
6,877,301 B2 * 4/2005 Nwosu ..... A01D 34/005 56/DIG. 5
6,939,079 B2 9/2005 Lloyd
7,004,675 B2 * 2/2006 Wayne ..... E01C 23/065 404/90

(Continued)

FOREIGN PATENT DOCUMENTS

CN 208023378 U 10/2018
DE 102017010919 B4 * 8/2023 ..... E01C 23/088
FR 2789415 A1 * 8/2000 ..... E01C 21/00

*Primary Examiner* — Christopher J Sebesta
*Assistant Examiner* — Katherine J Chu

(57) ABSTRACT

A milling machine includes a frame, a plurality of wheels or track members coupled to the frame, a moldboard movably coupled to the frame, a first rotor, and a second rotor. The first rotor is rotatably coupled to the frame. The second rotor is positioned to the rear of the first rotor and rotatably coupled to the moldboard.

20 Claims, 3 Drawing Sheets

(56) References Cited

U.S. PATENT DOCUMENTS

| | | | | |
|---|---|---|---|---|
| 7,748,789 | B2 * | 7/2010 | Freeburn | E01C 23/088 404/94 |
| 8,262,168 | B2 * | 9/2012 | Hall | E01C 23/088 404/90 |
| 8,403,595 | B2 * | 3/2013 | Hall | E01C 23/088 299/39.1 |
| 9,328,468 | B2 * | 5/2016 | Emme | E01C 23/088 |
| 10,385,523 | B2 * | 8/2019 | Bjorge | E01C 23/127 |
| 10,450,709 | B2 * | 10/2019 | Emme | E01C 23/127 |
| 10,612,196 | B2 * | 4/2020 | Johnson | E01C 23/088 |
| 10,619,314 | B2 * | 4/2020 | Safir | B02C 18/0084 |
| 10,776,638 | B2 * | 9/2020 | Engelmann | E01C 23/127 |
| 2013/0195554 | A1 * | 8/2013 | Rukavina | E01C 23/088 404/90 |
| 2021/0355647 | A1 * | 11/2021 | Stocks | E02D 3/032 |

* cited by examiner

MILLING MACHINES, SYSTEMS, AND RELATED METHODS

TECHNICAL FIELD

The present disclosure relates generally to a road construction machines, and more particularly, to milling machines, systems, and related methods.

BACKGROUND

The present invention relates to milling machines that are used in road surface repairs. Milling machines are typically utilized to mill and, optionally, remove a layer or layers of old or defective road surface in preparation for resurfacing or other road treatment. Machines, such as cold planers, rotary mixers, and other milling machines, are used for scarifying, removing, mixing, or reclaiming material from ground surfaces, such as, grounds, roadbeds, and the like. Such machines include a rotor enclosed within a rotor chamber. Some machines, including cold planers, include a conveyor assembly, which conveys fragments from the rotor chamber away from the road surface, for example, to a truck. The rotor includes a cylindrical drum or shell member and a number of cutting assemblies mounted on the shell member. When the machine is performing a cutting operation, cutting bits of the cutting assemblies impact the surface and break it apart. Thus, the cutting assemblies are arranged to cut the surface and to leave a milled surface that meets a known texture or surface finish requirement. Another function of the cutting assemblies is to form an auger that moves material within the rotor chamber, for example, to a central area of the rotor chamber from where it can be moved by the conveyor assembly to the truck. In these aspects, the arrangement and/or pitch of the cutting assemblies may affect the cutting operation, including, for example, the resulting texture, surface finish, and/or roughness of the resulting milled surface.

French Patent No. 2789415, issued to Medinger on August 11, 200 ("the '415 patent"), describes a milling machine with two rotors. The rotors are positioned between four wheels under a frame of the machine, and the two rotors are transversely spaced apart. The rotors scour and crush the soil traversed by the machine. The two rotors may increase the traction of the machine. Additionally, the second rotor is positioned lower than the first rotor, so that the first rotor may work a first portion of the ground surface, and the second rotor may work a second portion of the ground surface. However, the rotors of the '415 patent may not provide sufficient adjustment and/or control of the characteristics of the resulting surface finish formed by the milling machine. The machines, systems, and related methods of the present disclosure may solve one or more of the problems set forth above and/or other problems in the art. The scope of the current disclosure, however, is defined by the attached claims, and not by the ability to solve any specific problem.

SUMMARY

In one aspect, a milling machine may include a frame, a plurality of wheels or track members coupled to the frame, a moldboard movably coupled to the frame, a first rotor, and a second rotor. The first rotor may be rotatably coupled to the frame. The second rotor may be positioned to the rear of the first rotor and rotatably coupled to the moldboard.

In another aspect, a milling system may include a first rotor and a second rotor. The first rotor may include a plurality of cutting assemblies spaced apart by a first pitch. The second rotor may be positioned to the rear of the first rotor. The second rotor may include a plurality of cutting assemblies. The plurality of cutting assemblies positioned on the second rotor may be spaced apart by a second pitch that is smaller than the first pitch.

In yet another aspect, a milling machine may include a frame, a plurality of wheels or track members, one or more side doors forming a milling chamber, a first rotor positioned within the milling chamber, and a second rotor positioned to the rear of the first rotor. The first rotor may be rotatably coupled to the frame. The second rotor may be rotatably positioned within the milling chamber. The second rotor may be laterally movable within the milling chamber via a supporting hydraulic cylinder.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or can be milled in the removal or formation of roadways. In this disclosure, relative terms, such as, for example, "about," "substantially," and "approximately" are used to indicate a possible variation of ±10% in a stated value. Although the current disclosure is described with reference to a milling machine, this is only exemplary. In general, the current disclosure can be applied as to any machine, such as, for example, a cold planer, reclaimer, or another milling-type machine.

Figure 1:
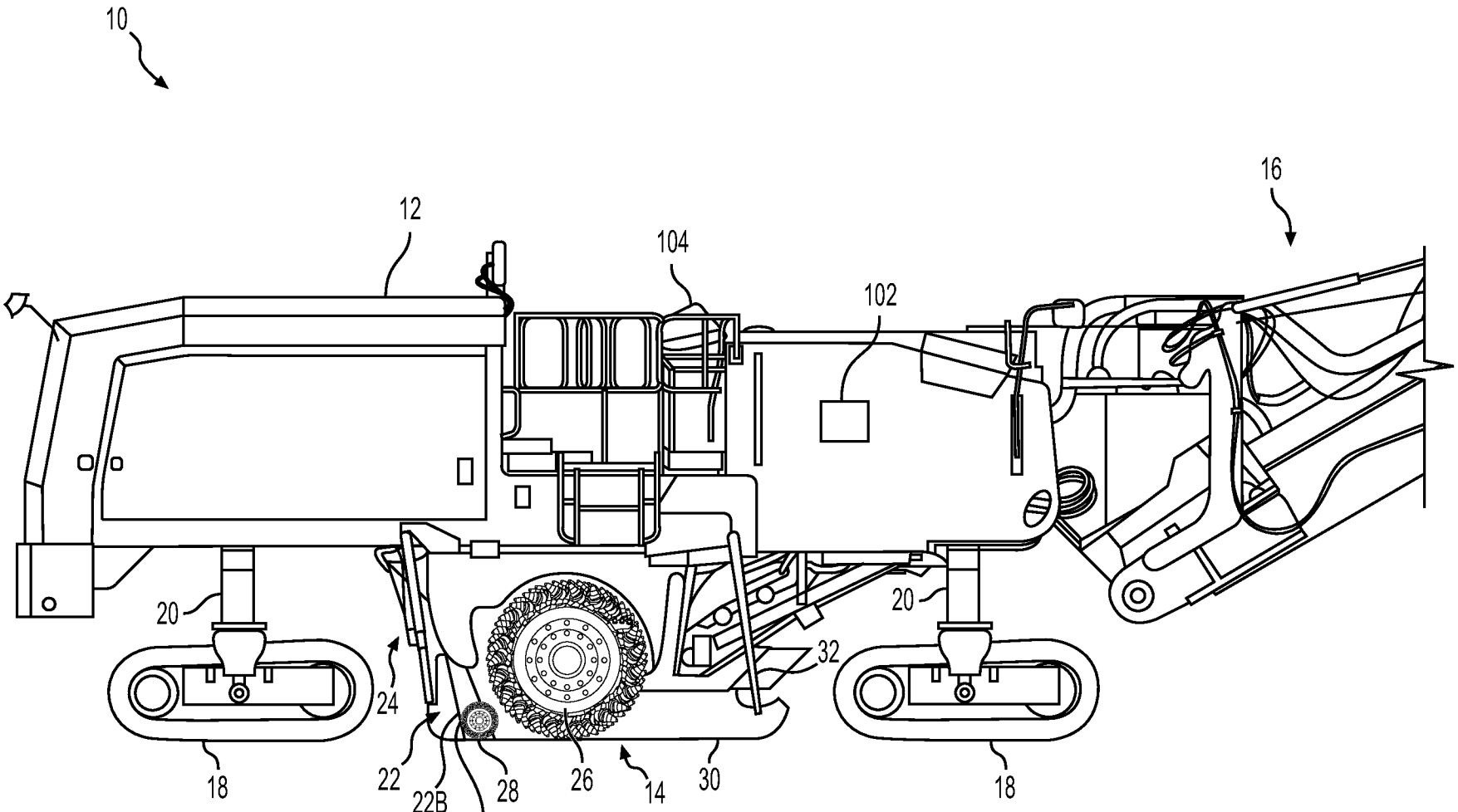
FIG. 1 is a side schematic view of an exemplary machine.

FIG. 1 illustrates a perspective view of an exemplary milling machine 10, according to the present disclosure. Machine 10 includes a frame 12 and a milling system or a milling assembly 14 positioned on the underside of frame 12. Milling assembly 14 may be integrally formed with frame 12 or may be otherwise coupled to machine 10. Machine 10 also may include a conveyor assembly 16 configured to advance the milled material from milling assembly 14 away from the ground surface, for example, to be deposited into a bed of a truck. Machine 10 includes a plurality of wheels or track members 18, which may be coupled to frame 12 via a plurality of adjustable supports, for example, hydraulic cylinders 20. The movement and/or position of hydraulic cylinders 20 may control the height of frame 12 and milling assembly 14 from the ground surface. The movement and/or position of hydraulic cylinders 20 may depend on the movement and pressure of hydraulic fluid, within hydraulic cylinders 20, as is known to one having skill in the art. In some aspects, machine 10 also includes a moldboard 22 positioned to the rear of milling assembly 14 via a moldboard support structure 24. As discussed in detail below, milling assembly 14 includes a forward or first rotor 26 and a rear or second rotor 28. First rotor 26 may be rotatably coupled to frame 12, for example, via one or more support arms or mounting structures (not shown). Second rotor 28 may be rotatably coupled to moldboard 22 via one or more coupling elements 40 (FIG. 2), or otherwise coupled to frame 12. For example, second rotor 28 may be slidable relative to moldboard 22, for example, to slide in and/or out of the milling chamber. Alternatively or additionally, second rotor 28 may be coupled to frame 12 via a hook-on and/or quick mount coupling.

Figure 2:
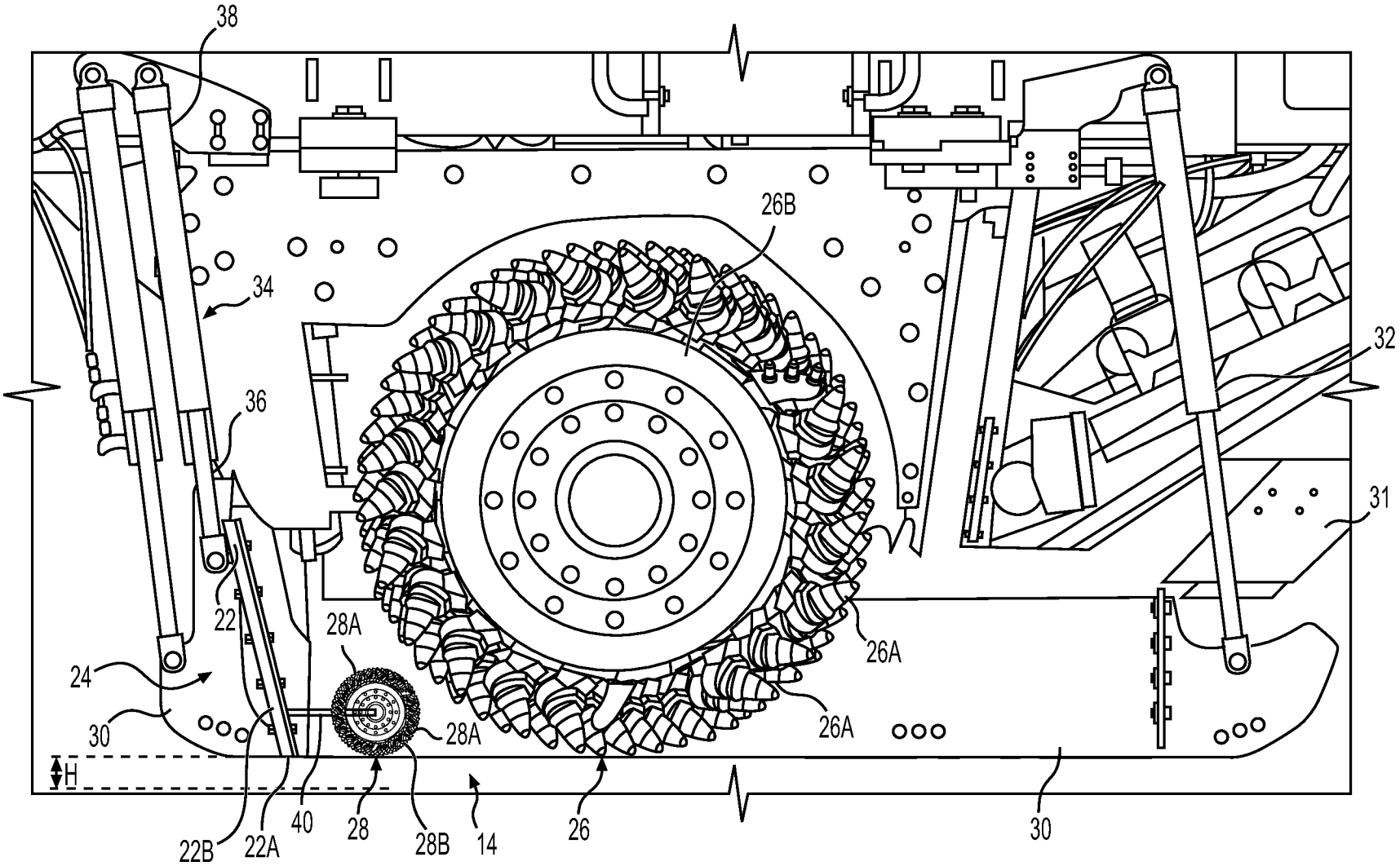
FIG. 2 is an enlarged view of a rotor chamber of the machine of FIG. 1, including first and second rotors.

First rotor 26 and second rotor 28 may rotate in the same direction, for example, counter-clockwise in FIGS. 1 and 2, to mill the ground surface. Alternatively, first rotor 26 may rotate in a first direction, for example, counter-clockwise in FIGS. 1 and 2, to mill the ground surface, and second rotor 28 may rotate in a second, different direction, for example, clockwise in FIGS. 1 and 2, to mill the ground surface. Second rotor 28 may be smaller than first rotor 26, for example, in diameter. In this aspect, second rotor 28 may be lighter and/or more easily carried or otherwise manipulated than first rotor 26. In another aspect, second rotor 28 may be substantially the same size (e.g., in diameter) as first rotor 26. In either of these aspects, first rotor 26 and second rotor 28 may each be positioned substantially horizontal (i.e., parallel to a lateral axis of frame 12 of machine 10), and may thus be positioned parallel to each other. In some aspects, second rotor 28 may be positioned at or below a milling depth of first rotor 26, for example, to cut at a lower plane than first rotor 26 (e.g., by a height H, as shown in FIG. 2). Furthermore, second rotor 28 may be shorter (e.g., in a lateral width) than first rotor 26. Alternatively or additionally, second rotor 28 may be formed by two or more rotor sections, for example, with one or more support elements connecting and/or supporting the rotor sections. In one or more aspects, second rotor 28 may have a different cutting bit spacing, or pitch, than first rotor 26. In one or aspects, a scraper blade (not shown) may be positioned between first rotor 26 and second rotor 28, for example, to help direct milled material toward conveyor assembly 16 and/or to help prevent milled material from impacting and/or impairing the milling of second rotor 28. With a scraper blade positioned between first rotor 26 and second rotor 28, second rotor 28 may rotate in an opposite direction as first rotor 26. Furthermore, machine 10 may include a controller 102 and one or more user interfaces 104, for example, positioned at one or more operation stations on machine 10 and/or remote from machine 10. Controller 102 and/or user interface 104 may help control various aspects of machine 10, including milling assembly 14.

It is noted that milling assembly 14 may include side doors 30 on each side portion of milling assembly 14. However, FIGS. 1-3 only illustrate one side door 30 in order to illustrate features of milling assembly 14. Moldboard 22, side doors 30, and a front door 31 (FIG. 2) form a milling chamber and enclose milling assembly 14, including first rotor 26 and second rotor 28, such that milling assembly 14 may engage and mill the ground surface. Each side door 30 may be movably coupled to frame 12 via at least one side hydraulic cylinder 32, for example, in order to raise side door 30 to inspect or repair milling assembly 14 and/or the internal drum assembly. Front door 31 may extend parallel to a rotational axis of first rotor 26, and a position of front door 31 may also be adjustably controlled via a hydraulic cylinder. The front door may float on the ground surface ahead of milling assembly 14. The front door may also be movable, for example, to access first rotor 26 for repair, replacement, inspection, etc.

In some aspects, moldboard 22 may help milling assembly 14 to remove the ground surface by removing any loose aggregate or debris that has not been captured by the milling drum assembly. Moldboard 22 may help to push the loose aggregate back toward the milling drum assembly, which may then urge the aggregate to conveyor assembly 16. Removing the loose aggregate may help yield a clean and smooth milled surface behind machine 10, which may then be more easily resurfaced. In order to help urge any loose aggregate toward the milling drum assembly, although not shown, moldboard 22 may also include an angled interior surface and/or nozzles to dispense fluid. As discussed in greater detail below, moldboard support structure 24 connecting moldboard 22 to machine 10 may help increase the range and/or degree of freedom of motion of moldboard 22 to accurately traverse the ground surface.

Moldboard 22 may be mounted to a rear portion of machine 10 via moldboard support structure 24. As shown in FIG. 2, moldboard support structure 24 includes a rear hydraulic cylinder 34. Rear hydraulic cylinder 34 may include a piston rod 36 movable within and extending from a piston barrel 38. The movement and position of piston rod 36 relative to piston barrel 38 may depend on the movement and pressure of hydraulic fluid, as is known to one having skill in the art. Although not shown, moldboard support structure 24 may include a trunnion mount, which may be coupled to piston barrel 38 in order to couple rear hydraulic cylinder 34 to milling assembly 14 or to frame 12. The trunnion mount may allow rear hydraulic cylinder 34 to pivot in one or more directions. Additionally, moldboard 22 may include a scraper blade 22A, for example, to engage with the milled ground surface. Scraper blade 22A may help to smooth the ground surface and/or to direct milled material toward conveyor assembly 16.

Figure 3:
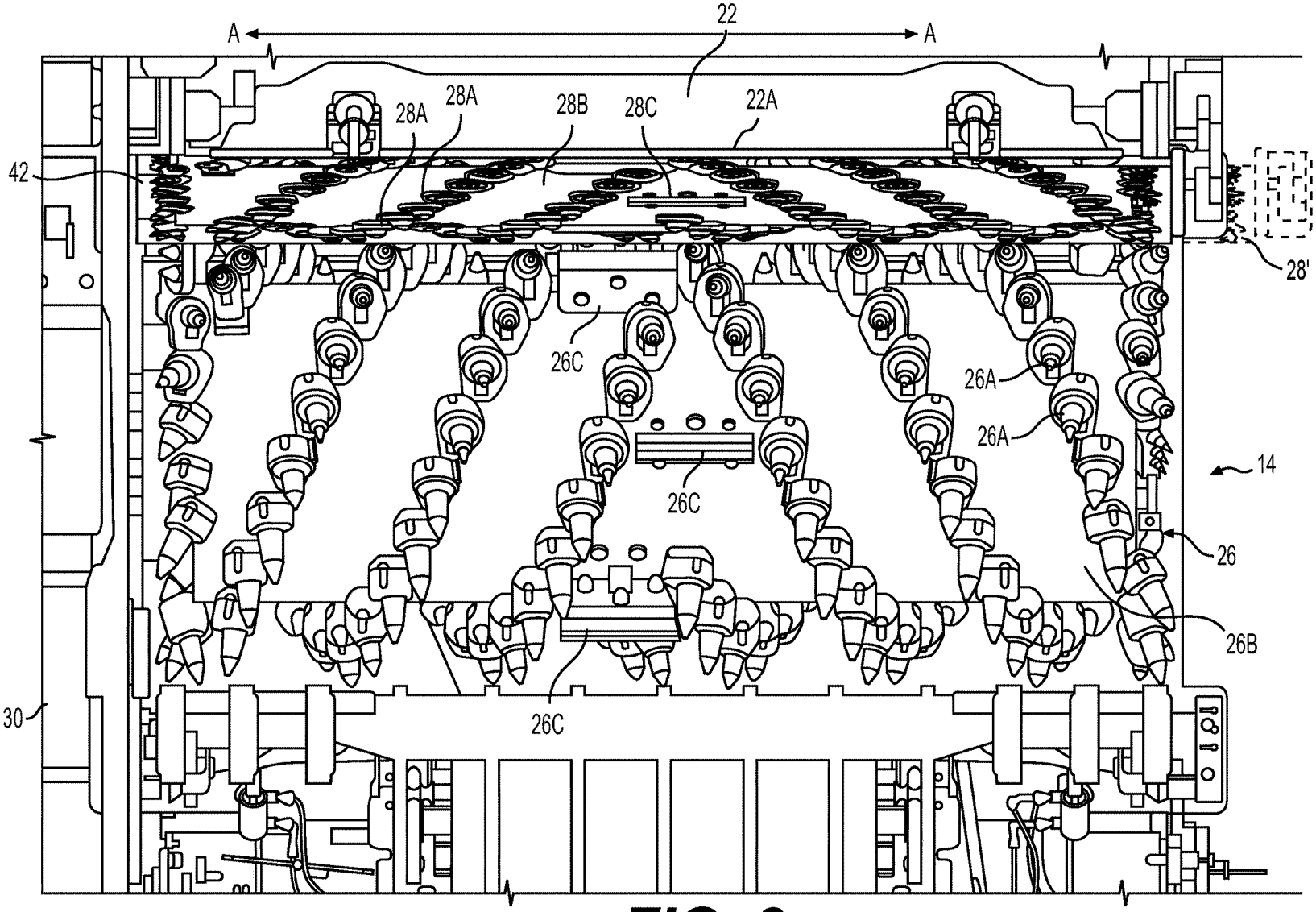
FIG. 3 is a bottom view of the rotor chamber of the machine of FIG. 1, including the first and second rotors.

In one or more aspects, second rotor 28 may be mounted to moldboard 22, for example, to a bottom portion 22B of moldboard 22. As shown in FIG. 2, second rotor 28 may be mounted to moldboard 22 via one or more coupling elements 40. Coupling element(s) 40 may fixedly couple second rotor 28 to moldboard 22, with moldboard 22 being vertically movable. Alternatively, coupling element(s) 40 may be movable (e.g., pivotable swing arms), to allow for adjustment of the vertical position of second rotor 28 relative to moldboard 22. In these aspects, movement (e.g., vertical movement) of moldboard 22 relative to frame 12 may adjust a position of second rotor 28, for example, relative to frame 12 and first rotor 26. As discussed below and as shown in FIG. 3, second rotor 28 may be movable (e.g., laterally movable) relative to moldboard 22 and/or to frame 12 via movement of a supporting hydraulic cylinder 42. For example, supporting hydraulic cylinder 42 may include a rod that is movable relative to a barrel, such that movement of the rod relative to the barrel may control a lateral position of second rotor 28 relative to frame 12 and/or first rotor 26. For example, second rotor 28 may be movable via hydraulic cylinder 42, and hydraulic cylinder 42 may be attached to a linkage arm set (not shown). Hydraulic cylinder 42 may be positioned within the milling chamber. In another aspect, at least a portion of hydraulic cylinder 42 may extend partially outside of the milling chamber with one or more rods and/or linkages that extend into the milling chamber and attach to one or more portions of second rotor 28. Although not shown, second rotor 28 may alternatively be rotatably coupled to one or more other components of the milling chamber and/or frame 12. In this aspect, second rotor 28 may be rotatably coupled to a separate adjustable support structure positioned within the milling chamber and/or otherwise coupled to the milling chamber and/or the frame. The movement of moldboard 22 and/or second rotor 28 may be controlled by controller 102 and/or user interface(s) 104. In one or more aspects, second rotor 28 may be rotatable via a hydraulic motor that is coupled to (e.g., directly coupled to) a drive axis of second rotor 28. In another aspect, second rotor 28 may be rotatable via a hydraulic motor positioned in a gear box and/or chaincase external to the milling chamber. Furthermore, in another aspect, second rotor 28 may be driven by a coupling to first rotor 26, for example, via a chaincase, gearbox, clutch mechanism, etc., such that second rotor 28 is driven by the same power source (e.g., engine and/or drive mechanism) that drives first rotor 26. In this aspect, second rotor 28 may be driven as a different rotational speed, power, torque, etc. than first rotor 26, for example, via a gearbox and/or clutch set.

In these aspects, second rotor 28 may include a second rotor pitch, for example, formed by cutting assemblies 28A mounted on a second rotor drum 28B. The second rotor pitch may be the same as or similar to a first rotor pitch, for example, formed by cutting assemblies 26A on a first rotor drum 26B. The pitch of second rotor 28 may be the same as the pitch of first rotor 26, such that first rotor 26 and second rotor 28 have the same spacings of respective cutting assemblies. However, lateral movement of second rotor 28, for example, via supporting hydraulic cylinder 42, may adjust the position of the cutting elements on second rotor 28 relative to the cutting elements on first rotor 26, for example, to a shifted position shown as second rotor 28' in FIG. 3. In these aspects, positioning second rotor 28 in alignment with first rotor 26 may form a first surface finish on the ground surface, and positioning second rotor 28 out of alignment with first rotor 26 (e.g., off-center) may form a second surface finish on the ground surface, for example, smoother than the first surface finish. Alternatively or additionally, second rotor 28 may include a smaller or finer pitch, such that second cutting assemblies 28A may be positioned closer together than the spacing of first cutting assemblies 26A on first rotor 26. In these aspects, second rotor 28 may form a smoother surface finish on the ground surface than first rotor 26.

In one or more aspects, controller 102 and/or user interface(s) 104 may help to control a position of second rotor 28, for example, relative to frame 12 and/or first rotor 26. Controller 102 and/or user interface(s) 104 may also help to control a position of first rotor 26, for example, by controlling one or more of hydraulic cylinders 20 that couple frame 12 to track members 18. Additionally, controller 102 and user interface 104 may help to control one or more additional aspects of machine 10, for example, a speed of conveyor assembly 16, a speed of machine 10 (e.g., via speed(s) of track members 18), a height of frame 12 and/or milling assembly 14 (e.g., via hydraulic cylinders 20), etc. In these aspects, controller 102 and user interface 104 may be coupled (e.g., wired or wirelessly). Additionally, although not shown, controller 102 may be coupled to (e.g., through a wired or wireless connection) one or more sensors, one or more controllers, and/or one or more actuators on machine 10. For example, controller 102 may be coupled to one or more sensors, one or more controllers, and/or one or more actuators for track members 18, hydraulic cylinders 20, first rotor 26, second rotor 28, side hydraulic cylinder 32, rear hydraulic cylinder 34, supporting hydraulic cylinder 42, etc.

FIGS. 2 and 3 illustrate milling assembly 14, including first rotor 26 and second rotor 28. As shown, first rotor 26 includes a plurality of first cutting assemblies 26A mounted on a first rotor drum 26B. As shown in FIG. 3, first cutting assemblies 26A may be arranged in a spiral pattern on first rotor drum 26B. Similarly, second rotor 28 includes a plurality of second cutting assemblies 28A mounted on second rotor drum 28B, and second cutting assemblies 28A may be arranged in a spiral pattern on second rotor drum 28B. In one or more aspects, and as shown in FIGS. 2 and 3, second cutting assemblies 28A may be smaller than first cutting assemblies 26A. In another aspect, second cutting assemblies 28A may be closer together (i.e., have a smaller pitch) than first cutting assemblies 26A. First cutting assemblies 26A and second cutting assemblies 28A may include different materials or other characteristics. As shown in FIG. 3, first rotor 26 may include one or more first material deflectors 26C, and second rotor 28 may include one or more second material deflectors 28C. First material deflector(s) 26C and second material deflector(s) 28C may be positioned in laterally central positions of first rotor 26 and second rotor 28, respectively, and may help to directed milled material, for example, toward conveyor assembly 16. Furthermore, in one or more aspects, each of first cutting assemblies 26A and second cutting assemblies 28A may each include one or more of a rotor standoff, a drum block, a tool block or a base block, a tool holder, and a cutting tool. The cutting tools may be replaceable, for example, as the cutting bits may wear down during milling procedures. Additionally, one or more other components of first cutting assemblies 26A and second cutting assemblies 28A may also be replaceable. In one or more aspects, second cutting assemblies 28A may have different material properties than first cutting assemblies 26A. For example, second cutting assemblies 28A may be harder than first cutting assemblies 26A. In this aspect, second cutting assemblies 28A may be formed of a diamond-like material, and first cutting assemblies 26A may be formed of a steel or other appropriate metallic material.

As mentioned above, second rotor 28 may be separately controllable from first rotor 26. For example, first rotor 26 may be coupled to a first rotor drive (not shown) in order to drive the rotation of first rotor drum 26B, and second rotor 28 may be coupled to a second rotor drive (not shown) in order to drive the rotation of second rotor drum 28B. In these aspects, first rotor 26 and second rotor 28 may rotate at different rates. Additionally, one or more of first rotor 26 or second rotor 28 may rotate to mill the ground surface, while the other of first rotor 26 or second rotor 28 may be stationary. Alternatively or additionally, first rotor 26 and second rotor 28 may rotate at different rotational speeds, with different powers or torques, other otherwise with different characteristics. For example, second rotor 28 may rotate at a greater speed than first rotor 26, but with less power or torque.

As mentioned above, second rotor 28 may be mounted to or otherwise coupled to moldboard 22. For example, as shown in FIG. 2, coupling element(s) 40 may couple second rotor 28 to moldboard 22. In one or more aspect, although not shown, milling assembly 14 may include left and right coupling elements to rotatably couple second rotor 28 to moldboard 22. In these aspects, adjusting a height of moldboard 22 may adjust the vertical position of second rotor 28. For example, moldboard 22 may be lowered via rear hydraulic cylinder 34 (e.g., extending piston rod 36 relative to piston barrel 38). In this aspect, lowering moldboard 22 also lowers second rotor 28. For example, first rotor 26 may be fixedly coupled to frame 12, and hydraulic cylinders 20 may control the position of frame 12, and thus the position of first rotor 26. Then, rear hydraulic cylinder 34 may control the position of moldboard 22, and thus second rotor 28, relative to frame 12. In these aspects, moldboard 22 may be positioned such that second rotor 28 is positioned at the same height as first rotor 26, as shown in FIG. 2. Moreover, moldboard 22 may be lowered such that second rotor 28 is positioned at a height lower than first rotor 26, for example, by a height H below a cutting plane formed by first rotor 26. Alternatively, although not shown, second rotor 28 may be mounted to or otherwise coupled to one or more elements of frame 12 or milling assembly 14, for example, via an adjustable support structure, such that the vertical position of second rotor 28 may be adjustable.

In these aspects, first rotor 26 may cut the ground surface to a first depth, and then second rotor 28 may follow behind first rotor 26 and cut the ground surface to a second depth, for example, with the second depth being deeper than the first depth by height H. Furthermore, the cut in the ground surface formed by first rotor 26 may be greater than height H, such that first rotor 26 cuts a greater depth or amount of ground surface material than second rotor 28. In these aspects, second rotor 28 may be a finishing rotor, for example, forming a smoother surface finish than first rotor 26. Additionally, the position of first rotor 26 (i.e., via frame 12 and hydraulic cylinders 20) and/or the position of second rotor 28 (i.e., via moldboard 22 and rear hydraulic cylinder 34) may be controlled by one or more of controller 102 and/or user interface 104. Alternatively, in one aspect, second rotor 28 may be positioned at a fixed position relative to first rotor 26, for example, at height H below the cutting plane formed by first rotor 26.

As shown in FIG. 3, second rotor 28 may be mounted on supporting hydraulic cylinder 42. Supporting hydraulic cylinder 42 may control a lateral position of second rotor 28 relative to frame 12 and/or first rotor 26. In these aspects, the lateral position of second rotor 28 may affect the surface finish on the ground surface formed by machine 10 and milling assembly 14. As discussed above, in some aspects, second cutting assemblies 28A of second rotor 28 may be substantially aligned with first cutting assemblies 26A of first rotor 26. In this configuration, milling assembly 14 may form a first surface finish on the ground surface. Furthermore, supporting hydraulic cylinder 42 may adjust (i.e., laterally sideshift left or right in direction A) second rotor 28 such that second cutting assemblies 28A are no longer aligned with first cutting assemblies 26A. In this configuration, milling assembly 14 may form a second surface finish on the ground surface. In some aspects, the second surface finish may be smoother than the first surface finish. In one or more aspects, the configuration of supporting hydraulic cylinder 42, and thus second rotor 28, may be continuously activated, moved, driven, or otherwise adjusted (e.g., side-shifting or oscillating left and right). In this aspect, supporting hydraulic cylinder 42, and thus second rotor 28, may be continuously adjusted between a left-most position and a right-most position (e.g., relative to frame 12 of machine 10). Continuously oscillating or side-shifting supporting hydraulic cylinder 42 and thus second rotor 28 may form another surface finished on the ground surface, for example, smoother than the first surface finish and/or the second surface finish. Moreover, in some aspects, the lateral position of second rotor 28 (i.e., via supporting hydraulic cylinder 42) may be controlled by one or more of controller 102 and/or user interface 104.

As mentioned, moldboard 22 is coupled to frame 12 via moldboard support structure 24. In these aspects, moldboard 22 may be lifted, for example, away from the ground surface, by retracting piston rod 36 relative to piston barrel 38. Lifting moldboard 22 may provide for access to second rotor 28, for example, to repair, replace, or otherwise inspect various portions of second rotor 28. For example, an operator may clean second rotor 28, repair one or more cutting assemblies 28A, replace one or more cutting assemblies 28A, replaced second rotor 28 (e.g., by uncoupling second rotor 28 from coupling element 40 and/or supporting hydraulic cylinder 42), or otherwise access second rotor 28. In one aspect, the operator may adjust the configuration of one or more cutting assemblies 28A, for example, by adjusting an orientation of one or more cutting bits, to modify the pitch of second rotor 28, which may modify the surface finish on the ground surface milled by machine 10. In another aspect, the operator may replace second rotor 28 with another second rotor. The another second rotor may be the same as second rotor 28, for example, if second rotor 28 was in need of significant repairs, cleaning, and/or replacement. Alternatively, the another second rotor may have a different size (i.e., a larger drum), a different pitch of cutting assemblies, a different size of cutting assemblies, or one or other different characteristics. In these aspects, machine 10 and milling assembly 14 may form a different surface finish on the ground surface with the another second rotor.

INDUSTRIAL APPLICABILITY

The disclosed aspects of machine 10 may be used in any milling machine to assist in removal of the milled material, while allowing for variations in milling depth, variations in the surface finish produced by machine, access to the milling chamber, etc. As mentioned above, second rotor 28 may be positioned to the rear of first rotor 26, so that first rotor 26 may perform a bulk of the milling procedure performed by milling assembly 14. Second rotor 28 may be smaller, have a different pitch of cutting assemblies 28A, move laterally within the milling chamber, rotate faster, or otherwise operate to perform secondary milling and to form a smoother surface finish than first rotor 26. Additionally or alternatively, second rotor 28 may be selectively activated. In this aspect, second rotor 28 may be selectively driven to rotate such that second rotor 28 engages and mills the ground surface, for example, to leave a surface finish that is smoother than the surface finish formed by first rotor 26, to mill the ground surface to a greater depth than first rotor 26 (e.g., by height H), etc. Moreover, second rotor 28 may be selectively activated, moved, driven, or otherwise adjusted between a left-most position and a right-most position (e.g., side-shifted or oscillated). Furthermore, some milling procedures may not require a smoother surface finish. In such instances, second rotor 28 may be positioned above the cutting plane of first rotor 26, such that second rotor 28 is not actively engaged in milling the ground surface, preserving and/or extending the working life of second rotor 28 and its cutting assemblies 28A for other milling procedures. As mentioned, the position(s) of second rotor 28 (and thus the resulting surface finish on the ground surface) may be controlled by controller 102 and/or one or more user interfaces 104. In these aspects, second rotor 28 may allow an operator to adjust a surface finish produced by machine 10 without adjusting first rotor 26, improving the efficiency, efficacy, and/or production of milling assembly 14 and machine 10.

Second cutting assemblies 28A may be formed of a harder material (i.e., a cutting bit) than first cutting assemblies 26A. As second rotor 28 is milling an already milled surface and/or a smaller depth of material, second cutting assemblies 28A may wear at a lower rate than first cutting assemblies 26A. Additionally, second rotor 28 may be coupled to moldboard 22, for example, via coupling element 40, or otherwise positioned adjacent to or near moldboard 22 (FIGS. 1-3). As such, raising moldboard 22 may provide access to second rotor 28, for example, to repair, replace, or otherwise inspect various portions of second rotor 28. As mentioned, an operator may clean second rotor 28, repair one or more of second cutting assemblies 28A, replace one or more of second cutting assemblies 28A, replace second rotor 28 (e.g., by uncoupling second rotor 28 from coupling element 40 and/or supporting hydraulic cylinder 42), or otherwise access second rotor 28.

Additionally, second rotor 28 may be smaller and/or lighter than first rotor 26, for example, allowing for second rotor 28 to be more easily manipulated and/or replaced than first rotor 26. In this aspect second rotor 28 may be replaced when damaged. Alternatively or additionally, second rotor 28 may be exchanged for a different second rotor 28, for example, with a different pitch, hardness, or one or more other characteristics of second cutting assemblies 28A, which may provide a different surface finish on the ground surface. In another aspect, the operator may access second rotor 28 to adjust one or more characteristics of second rotor 28, for example, adjusting an arrangement of cutting bits on cutting assemblies 28A, replacing the cutting bits with different (i.e., harder, wider, etc.) cutting bits, etc. For example, a method may include performing a first milling procedure with a first second rotor 28 to form a first surface finish on the milled ground surface. The method may then include accessing the milling chamber and removing the first second rotor 28. The method may then include coupling another second rotor 28 to milling assembly 14 (e.g., to moldboard 22), with the another second rotor 28 having one or more different milling properties than the first second rotor 28. Alternatively, the method may include modifying one or more characteristics of the first second rotor 28 to change the milling properties. Then, the method may include performing another milling procedure, with the changed milling properties forming a second surface finish on the milled ground surface. Furthermore, in some aspects, second rotor 28 may help to protect moldboard 22, for example, from larger pieces of milled material impacting or otherwise damaging moldboard 22.

It will be apparent to those skilled in the art that various modifications and variations can be made to the disclosed machine without departing from the scope of the disclosure. Other embodiments of the machine will be apparent to those skilled in the art from consideration of the specification and practice of the milling devices, systems, and methods disclosed herein. It is intended that the specification and examples be considered as exemplary only, with a true scope of the disclosure being indicated by the following claims and their equivalents.

What is claimed is:

1. A milling machine, comprising:

a frame;

a plurality of wheels or track members coupled to the frame;

a moldboard movably coupled to the frame such that the moldboard is movable vertically relative to the frame, wherein a bottom portion of the moldboard includes a scraper blade to engage with a milled ground surface;

a first rotor, wherein the first rotor is rotatably coupled to the frame; and a second rotor positioned to the rear of the first rotor and rotatably coupled to the moldboard via one or more coupling elements, and wherein the second rotor is laterally movable relative to the moldboard.

2. The milling machine of claim 1, wherein the second rotor is laterally movable relative to the moldboard via a supporting hydraulic cylinder, and wherein the supporting hydraulic cylinder is positioned within a milling chamber of the milling machine.

3. The milling machine of claim 1, wherein the second rotor includes a smaller diameter than the first rotor.

4. The milling machine of claim 3, wherein the first rotor includes a plurality of cutting assemblies spaced apart by a first pitch, and wherein the second rotor includes a plurality of cutting assemblies spaced apart by a second pitch.

5. The milling machine of claim 4, wherein the first pitch and the second pitch are the same.

6. The milling machine of claim 4, wherein the second pitch is smaller than the first pitch.

7. The milling machine of claim 1, further comprising a controller, wherein the controller is coupled to the moldboard, the first rotor, and the second rotor, and wherein the controller is configured to adjust a height of the moldboard relative to the frame, adjust a rotational speed of the first rotor, adjust the rotational speed of the second rotor, or adjust a lateral position of the second rotor relative to the moldboard.

8. The milling machine of claim 1, wherein the second rotor is driven by a coupling to the first rotor such that the second rotor is driven by a same power source that drives the first rotor, and wherein the second rotor is driven at a different rotational speed, power, or torque than the first rotor via a gearbox or a clutch set.

9. A milling assembly, comprising:

a moldboard;

a first rotor, wherein the first rotor includes a plurality of cutting assemblies spaced apart by a first pitch; and a second rotor positioned to the rear of the first rotor, wherein the second rotor includes a plurality of cutting assemblies, wherein the plurality of cutting assemblies positioned on the second rotor are spaced apart by a second pitch that is smaller than the first pitch, wherein the second rotor is rotatably coupled to the moldboard, and wherein the second rotor is laterally movable relative to the moldboard via one or more hydraulic cylinders, and wherein the second rotor is driven by a coupling to the first rotor such that the second rotor is driven by a same power source that drives the first rotor.

10. The milling assembly of claim 9, wherein the moldboard is positioned to the rear of the second rotor and wherein the second rotor is driven at a different rotational speed, power, or torque than the first rotor via a gearbox or a clutch set.

11. The milling assembly of claim 10, further comprising one or more side doors, wherein the one or more side doors and the moldboard form a milling chamber.

12. The milling assembly of claim 11, wherein the moldboard is vertically movable relative to the one or more side doors via a rear hydraulic cylinder, wherein vertical movement of the moldboard adjusts a position of the second rotor relative to the first rotor, and wherein the second rotor and the moldboard are positionable at a height lower than a height of the first rotor.

13. The milling assembly of claim 12, wherein the moldboard is further vertically movable to provide for access to the second rotor.

14. The milling assembly of claim 12, further comprising a conveyor assembly that is configured to convey milled material from within milling chamber.

15. A milling machine, comprising:

a frame;

a plurality of wheels or track members;

a moldboard and one or more side doors forming a milling chamber;

a first rotor positioned within the milling chamber, wherein the first rotor is rotatably coupled to the frame; and a second rotor positioned to the rear of the first rotor and forward of the moldboard, wherein the second rotor is rotatably positioned within the milling chamber, wherein the second rotor is rotatably coupled to the moldboard via one or more coupling elements, wherein the moldboard is vertically movable such that a height of the second rotor is adjustable relative to the first rotor, and wherein the second rotor is laterally movable within and out of the milling chamber via a supporting hydraulic cylinder.

16. The milling machine of claim 15, wherein a height of the moldboard is adjustable relative to the frame via one or more hydraulic cylinders, such that the second rotor can be positioned at a height lower than a height of the first rotor.

17. The milling machine of claim 16, wherein the moldboard is further vertically movable to provide for access to the second rotor.

18. The milling machine of claim 15, wherein the first rotor includes a first plurality of cutting assemblies spaced apart by a first pitch, and wherein the second rotor includes a second size and a second plurality of cutting assemblies spaced apart by a second pitch that is the same as the first pitch.

19. The milling machine of claim 15, wherein the first rotor includes a first size and a first plurality of cutting assemblies spaced apart by a first pitch, wherein the second rotor includes a second size and a second plurality of cutting assemblies spaced apart by a second pitch that is smaller than the first pitch, and wherein the second size is smaller than the first size.

20. The milling machine of claim 19, wherein the second rotor is driven by a coupling to the first rotor such that the second rotor is driven by a same power source that drives the first rotor, and wherein the second rotor is driven at a different rotational speed, power, or torque than the first rotor via a gearbox or a clutch set.

* * * * *